United States Patent [19]

Campbell et al.

[11] Patent Number: 4,865,556

[45] Date of Patent: Sep. 12, 1989

[54] ELECTRICAL SWITCH DEVICE WITH NON-METALLIC MOUNTING STRAPS AND AUTOMATIC GROUNDING

[75] Inventors: Winston Campbell, Hempstead; Wade R. Bowden, Jr., Northport; Emma Levin, Brooklyn, all of N.Y.

[73] Assignee: Slater Electric Inc., Glen Cove, N.Y.

[21] Appl. No.: 176,902

[22] Filed: Apr. 4, 1988

Related U.S. Application Data

[63] Continuation-in-part of Ser. No. 10,373, Feb. 3, 1987.

[51] Int. Cl.[4] ..... H01R 4/66

[52] U.S. Cl. ..... 439/97; 29/622; 439/92

[58] Field of Search ..... 439/92, 95, 97, 109; 29/622; 200/315, 339

[56] References Cited

U.S. PATENT DOCUMENTS

| | | | |
|---|---|---|---|
| 3,082,303 | 3/1963 | Wiley | 200/339 X |
| 3,900,238 | 8/1975 | Anderson | 439/107 |
| 3,835,438 | 9/1974 | Longworth, Jr. | 339/14 R |
| 4,039,235 | 8/1977 | Thibeault | 339/14 |
| 4,203,638 | 5/1980 | Tansi | 339/14 P |
| 4,271,337 | 6/1981 | Barkas | 200/51.09 |
| 4,301,343 | 11/1981 | Joneus | 29/622 X |
| 4,352,964 | 10/1982 | English | 29/622 X |
| 4,379,605 | 4/1983 | Hoffman | 339/14 R |
| 4,392,012 | 7/1983 | Nattel | 439/92 X |

*Primary Examiner*—Eugene F. Desmond
*Attorney, Agent, or Firm*—Morgan & Finnegan

[57] ABSTRACT

An electrical switch device adapted to be secured to an electrical outlet box mounted behind a wall member, having elongated, non-metallic mounting straps formed integrally with the device cover, and an improved grounding system adapted to automatically ground a metallic wall plate intended for use with the device without using the usual metal mounting strap. The mounting straps are proportioned to the maximum possible dimensions to fit under the wall plate to abut the wall member so as to substantially reduce the chance of a floating installation. Grounding means affixed to the cover adjacent one of the mounting screw apertures is adapted to engage a mounting screw inserted through the aperture so as to provide good electrical communication therebetween. The grounding means is formed with a contact aperture alignable with a wall plate mounting hole formed in the device and proportioned such that the portions of the grounding means defining the aperture engage a wall plate mounting screw inserted through the mounting hole so as to provide a continuous electrically conductive ground path from the outlet box to the wall plate. The grounding means is further adapted to permit direct termination of a ground conductor in an electrical power cable to the switch as an alternate means for grounding the wall plate when grounding is not carried out through the device mounting screw.

39 Claims, 8 Drawing Sheets

ELECTRICAL SWITCH DEVICE WITH NON-METALLIC MOUNTING STRAPS AND AUTOMATIC GROUNDING

CROSS-REFERENCE TO RELATED APPLICATION

The present application is a continuation-in-part of patent application Ser. No. 07/010,373, filed on Feb. 3, 1987, which is now pending.

BACKGROUND AND OBJECTS OF THE INVENTION

The present invention relates generally to the grounding system for electrical wiring devices and, more particularly, to electrical switch devices having non-metallic mounting straps and an automatic grounding system for grounding metallic wall plates intended for use with the device to a grounded metallic electrical outlet box, while including a ground terminal for direct termination to the ground conductor of an electrical power cable.

Electrical switches for residential, hospital and industrial use are well known in the art. Hospital and industrial grades of switches are often made in specialized configurations or with heavy duty features in order to satisfy various code requirements (e.g., Underwriters' Laboratories Hospital Grade Test Program). Residential grade switches, on the other hand, are generally required to satisfy somewhat less stringent U.L. requirements and have been manufactured for years with little or no design changes so as to sell at the lowest possible cost. For example, such switches are often made with a body and cover member formed from a thermo-set material using the same type of compression molds which have been in use for decades.

Conventional electrical switches use steel mounting straps (or "ears") to mount the switch to an electrical outlet box, and as a means for grounding the metallic wall plate typically used to cover the switch installation. The steel mounting straps are typically either sandwiched between the switch cover and body, wrapped around the switch device, or fabricated into a continuous metal strip adapted to fit over the switch cover. In such installations, the ends of each strap are provided with mounting screw receiving apertures through which the device can be mounted to the outlet box. The portions of the mounting strap defining each receiving aperture electrically engage the appropriate mounting screw to establish a ground path between a pre-grounded outlet box (metallic) and the mounting strap. Additionally, the straps are typically tapped with small holes to accommodate wall plate mounting screws. The portions of the mounting straps defining each hole electrically engage the wall plate screw to complete the ground path and ground path the wall plate.

Although known prior switch devices have provided generally satisfactory results over the years, they do suffer several disadvantages. For example, the typically used thermoset materials are relatively brittle and are susceptible to cracking or breakage during fabrication or installation. The assembly method of these devices is also a source of problems. The body and cover, with the mounting strap held between them, are usually secured together by a fastening rivet or screw-like fastener which is inserted through the back of the switch body, through a clearance hole formed in the mounting strap and then force fit in a hole formed in the switch cover.

To insure adequate holding power, close tolerances are required between the outer diameter of the rivet or screw-like fastener and the holes in the switch body and cover. Thus, if blisters are formed in the vicinity of these holes during molding or if the parts are warped in that vicinity, the resultant parts are susceptible to cracking when the fastener is installed. Further, since the only means of securing the parts together is the rivet or screw fastener, the attachment of the cover and body is vulnerable to loosening, resulting in a dangerous intermittent condition in, or total disconnection of, the electrical connections within the device.

Another disadvantage of conventional electrical switches is the problem encountered when the wall opening cut to receive the receptacle is too large for one or both ends of the mounting strap to bear against the wall surface when the device is mounted to an electrical outlet box behind the wall. To compensate, electricians often rely on the device mounting screws to hold the switch in place. Such installation results in what is called a "floating" installation, wherein the device mounting screws are not tightened all the way so the device can "float" relative to the outlet box. Such "floating" installations are undesirable because they require extra installation time. The electrician must judge how far to tighten down the mounting screws to accommodate the wall plate, yet allow enough slack to pull the device back against the wall plate.

In a proper installation, the ends of both mounting straps should be sufficiently elongated to abut the wall and thus prevent the switch from floating. In the fabrication of steel mounting straps, however, this becomes prohibitively expensive. While the use of cheaper, non-metallic materials to construct the mounting straps may provide an economical alternative, it presents the concomitant problems of (1) providing a mounting strap of durable construction, and (2) providing a means for grounding the wall plate without relying upon the electrically conductive steel mounting strap.

It is therefore an object of the present invention to provide a new and improved electrical switch device which overcomes the foregoing drawbacks and is of rugged construction and capable of economical fabrication, particularly for residential grades. It is another object of the invention to provide a new and improved electrical switch device which can be fabricated essentially completely from thermo-plastic (including mounting strap portions) except for the electrical contacts/-terminals and ground elements.

It is also an object of the invention to provide a new and improved electrical switch device having mounting means adapted to substantially reduce the possibility of "floating" installations. In addition, it is an object of the invention to enable incorporation of such mounting feature in switches for various sized wall plates.

It is also an object of the present invention to provide a new and improved electrical switch device having a grounding system capable of automatically grounding a metallic wall plate intended for use with the device when it is mounted to a grounded metal electrical outlet box without requiring a metallic mounting strap. It is a further object of the invention to provide such a switch device which also incorporates alternate grounding means for direct termination to the ground conductor of an electrical power cable for installations where non-metallic outlet boxes are used.

It is yet another object of the present invention to provide an electrical switch device having a cover member and body which can be formed by simple two-part injection molding techniques. It is still another object of the invention to provide such a switch device having a mounting strap formed integrally with the cover member to simplify fabrication and reduce the number of component parts for the complete device.

Further, it is an object of the present invention to provide a new and improved electrical switch device capable of fully automated assembly by the use of component parts which can be secured in place before the final assembly step. It is another object of the invention to provide such a switch device and method of assembly which obviates the need for using the usual rivet or screwtype fastener yet forms a securely assembled switch.

Objects and advantages of the invention are set forth in part herein and in part will be apparent herefrom, or may be learned by practice with the invention, the same being realized and attained by means of the structures, instrumentalities and combinations pointed out in the appended claims. Accordingly, the invention resides in the novel parts, structures, arrangements, combinations, and improvements herein shown and described.

SUMMARY OF INVENTION

Briefly described, the electrical switch devices according to the present invention include a housing which comprises a body member having switching components and electrical terminal/contact members retained therein and a cover member attached to the body member, preferably with a pair of mounting strap elements formed integrally with, and projecting from opposite ends of, the cover member. As preferably embodied, the body, cover and integral mounting strap elements are all formed from an injection moldable, thermo-plastic material.

According to one specific aspect of the invention, grounding means are provided for automatically grounding a metallic wall plate affixed to the switch when mounted to a grounded electrical outlet box without requiring the usual steel mounting strap. According to one preferred embodiment of the invention for toggle-type switches, the grounding means comprises a unitary grounding element made in the form of a strip of electrically conductive material, preferably a copper alloy, in fixed electrical contact with an additional ground terminal member. The grounding element and terminal member are attached to the cover member adjacent to one of the mounting screw apertures such that the terminal member is fixedly positioned between the cover and grounding element in good electrical contact with the grounding element. The grounding element is adapted to engage and maintain good electrical contact with a device mounting screw inserted into the mounting screw aperture. The grounding element and additional terminal member are provided with cooperating receiving and contact apertures, respectfully, to receive a wall plate mounting screw threadably engaged with the cover member to affix a wall plate to the switch device. The contact aperture is proportioned so that the portions of the terminal member defining the aperture engage and electrically contact the wall plate mounting screw when inserted thereinto.

Thus, when the switch is secured to a pre-grounded electrical outlet box, and a metallic wall plate is affixed thereto, a continuous electrically conductive ground path is provided from the outlet box, through the device mounting screw, through the grounding element and terminal member, thence through the wall plate mounting screw to automatically ground the wall plate. Also advantageously, the terminal member is provided with a ground terminal screw for direct termination to the ground conductor of an electrical power cable to establish an alternate ground path from the wall plate to the ground conductor for installations where the outlet box is not pre-grounded.

According to another preferred embodiment of the invention for decorator-style switches, an electrically conductive metal strip grounding element is attached to the back of the cover member adjacent one of the mounting screw apertures, and is adapted to engage a device mounting screw inserted into the mounting screw aperture so as to maintain good electrical contact therewith. The grounding element has a contact aperture proportioned such that the portions of the grounding element defining the aperture will engage a wall plate mounting screw inserted into the device to affix the wall plate thereto. Thus, a continuous electrically conductive ground path is provided from the device mounting screw, through the grounding element, thence through the wall plate mounting screw to automatically ground the wall plate. Also, the device is adapted to permit direct termination of a ground conductor to the device by an additional ground member affixed to the cover in electrical contact with the grounding element and having a ground terminal screw for direct termination to the ground conductor.

According to another aspect of the invention, each integral mounting strap is elongated to the maximum length which will fit under a wall plate intended for use with the device. As preferably embodied, the mounting straps are formed generally in the configuration described in co-pending application Ser. No. 07/010,373, to facilitate maximum elongation of the mounting strap while still enabling the switch to fit completely under the lip of the wall plate.

It will be readily appreciated by those skilled in the art that the invention as disclosed and claimed herein achieves the objects and advantages specifically recited herein. For example, by forming the cover member with integral mounting strap elements, the overall fabrication costs and handling of parts will be substantially reduced. In addition, by elongating the integrally formed mounting strap elements in accordance with the present disclosure, the possibility of having a "floating" installation of the device is greatly reduced.

By providing the automatic grounding system disclosed herein, it will be found that the switch according to the invention can be automatically grounded to a pre-grounded electrical outlet box without requiring the usual steel mounting strap. In addition, the unitary grounding element according to the invention is substantially shorter, thinner and lighter than the conventional steel mounting strap and it is much easier to form and to handle during assembly.

Also, by providing the additional ground member which is in electrical communication with the grounding element according to the invention, the device is also capable of being directly terminated to the ground conducter of an electrical power cable for installation wherein the outlet box is not pre-grounded (i.e., wherein a plastic outlet box is used).

It should be understood that the foregoing general description and the following detailed description are exemplary and explanatory of the invention, but are not intended to be restrictive thereof or to be exhaustive of the advantages which can be achieved by the invention. The accompanying drawings, referred to herein, and constituting a part hereof, illustrate a preferred embodiment of the invention, and, when taken together with the following detailed description, serve to illustrate the principles and advantages of the invention.

DETAILED DESCRIPTION OF PREFERRED EMBODIMENT

Figure 1:
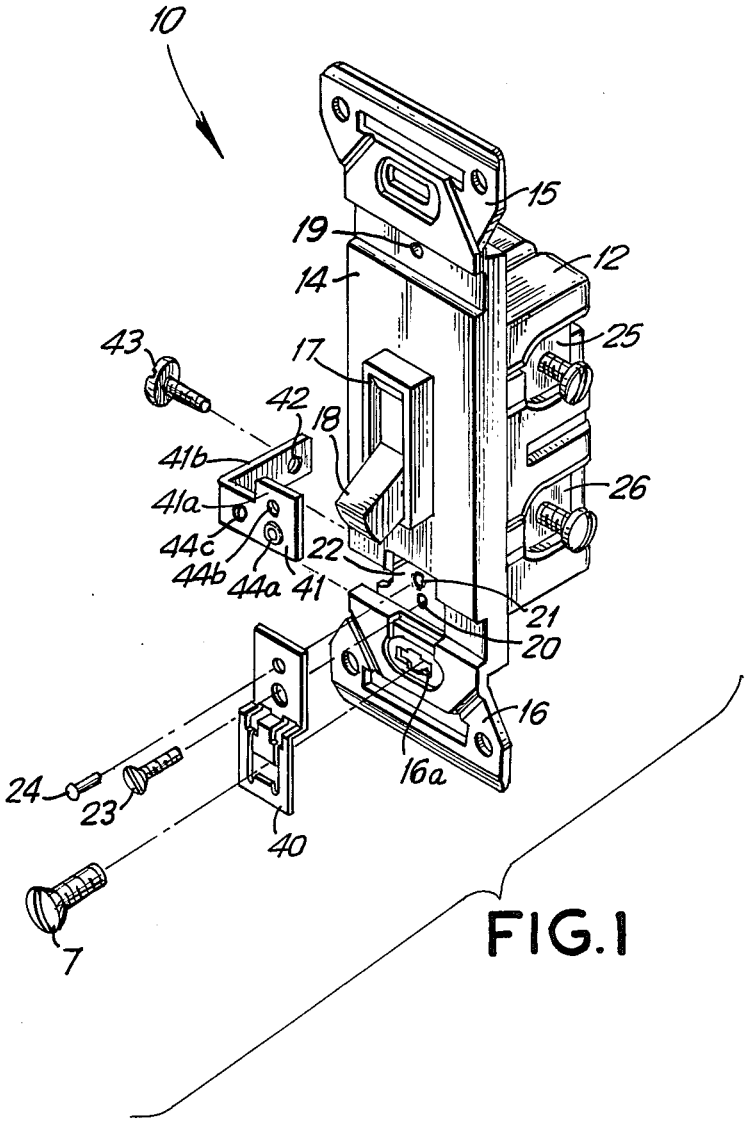
FIG. 1 is a perspective view, from the front side, of a preferred embodiment of an electrical toggle switch device according to the present invention.
Figure 2:
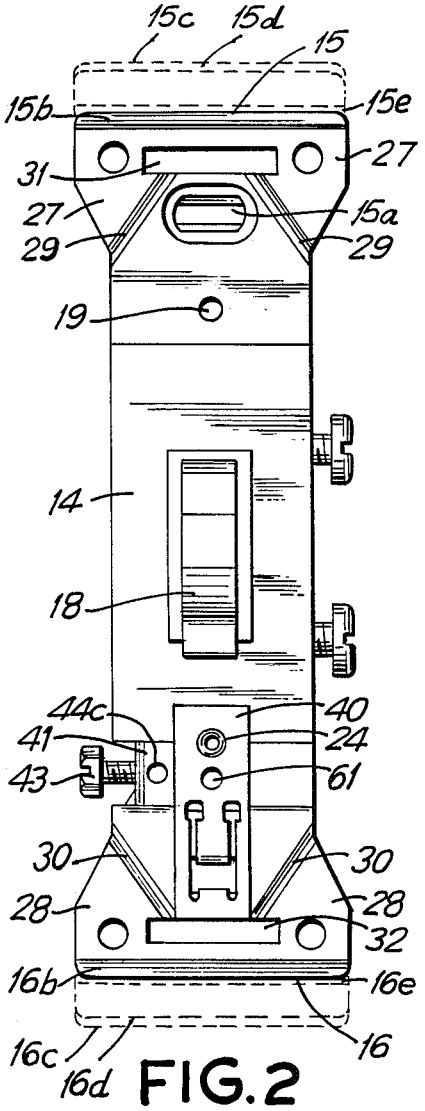
FIG. 2 is a front elevation view of the electrical toggle switch of FIG. 1.
Figure 3:
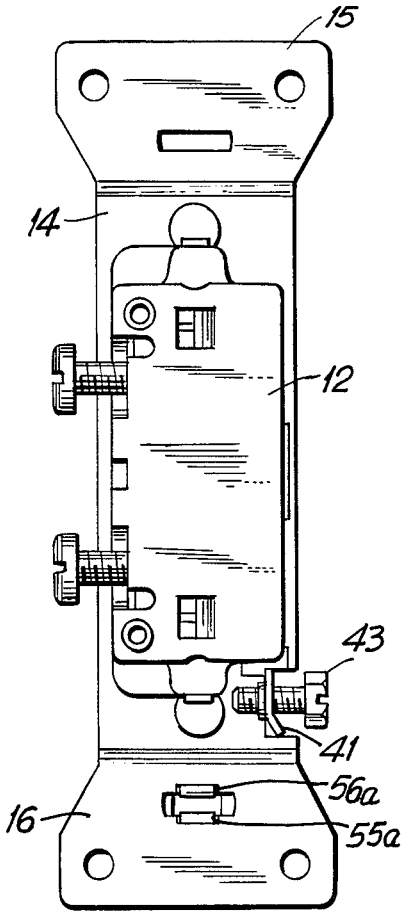
FIG. 3 is a rear elevation view of the electrical toggle switch of FIG. 1.
Figure 4:
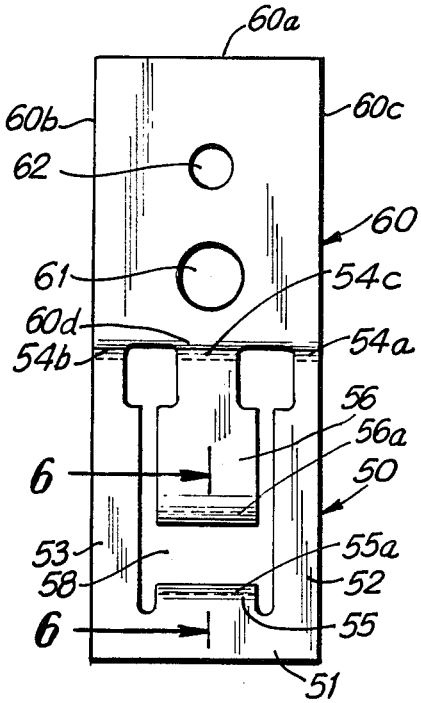
FIG. 4 is a top plan view of one embodiment of the grounding element according to the present invention.
Figure 5:
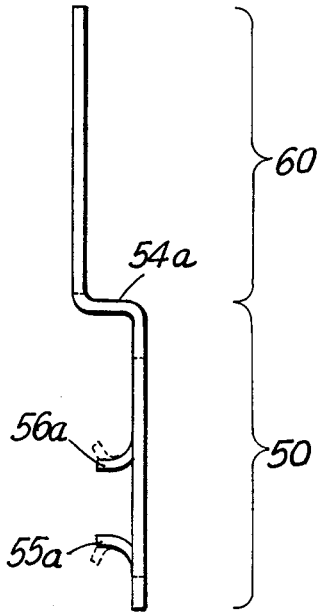
FIG. 5 is a side view of the grounding element shown in FIG. 4.
Figure 6:
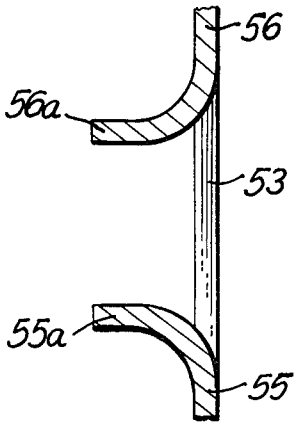
FIG. 6 is a sectional view taken along line 6-6 of the grounding element shown in FIG. 4.

Referring now to the embodiment of the invention illustrated in the accompanying drawings, wherein like reference characters refer to like parts throughout the various views, there is shown in FIGS. 1–6 a preferred embodiment of an electrical switch device (indicated generally at 10) according to the present invention. When fully assembled, switch 10 essentially comprises a housing made up of body member 12 and cover member 14 which carries mounting strap elements 15 and 16 for mounting the switch to an electrical outlet box (not shown), which is supported behind an opening in a wall member.

As here embodied, body 12 is made up of a bottom wall with a pair of oppositely disposed sidewalls and a pair of oppositely disposed endwalls upstanding from the bottom wall. The body includes several upstanding interior walls to define, e.g., the slots or compartments for receiving and retaining terminal/contact members 25 and 26, as well as the internal operating components of switch 10. Since these internal body structures are of generally conventional configuration, they need not be described in great detail. Only those structures which will facilitate an understanding of the various features of the present invention will be mentioned in detail hereinafter.

As embodied in FIG. 1, cover member 14 is provided with an aperture 17 for receiving toggle member 18, which facilitates the "on-off" activation/deactivation of the switch. Cover member 14 also is provided with mounting holes 19 and 20 for receiving the mounting screws of a wall plate (not shown).

For ease of fabrication and durability of parts, body member 12, cover member 14, and mounting strap elements 15 and 16 are preferably constructed of an injection moldable thermo-plastic material, the mounting strap elements being formed integrally with the cover member in a unitary structure. Any injection moldable thermo-plastic material acceptable for use in electrical wiring devices can be used, provided it satisfies the necessary flame, impact and other electrical and mechanical property tests required by Underwriters' Laboratories or any other applicable code. Examples of such acceptable materials include polyvinyl chloride, polycarbonates, nylon, etc., and/or blends of such materials which are formulated for good impact strength, good molding characteristics and low cost, particularly the polyvinyl chloride based composition formulated by Georgia Gulf Corp. for Slater Electric Inc., and designated "TECHNALLOY" by Slater Electric.

As here embodied, each mounting strap element includes an aperture (15*a*, 16*a*) proportioned to receive the device mounting screw. As will be described below, at least one of the apertures is adapted to achieve automatic grounding of the switch unit to a grounded electrical outlet box in accordance with the invention. As disclosed in the aforesaid parent application Ser. No. 07/010,373, the disclosure of which is incorporated herein by reference, the mounting strap elements preferably extend to the maximum possible length that can be accommodated under the wall plate to be used with the device and include continuous beveled front end edges, 15*b* and 16*b*, respectively, to fit under the end edges, or rim, of the wall plate. For example, for standard size wall plates, the overall length of strap elements 15 and 16 may be approximately 0.1 to 0.125 inches longer than conventional steel straps, for a total overall length of about 4 3/16 to about 4¼ inches. For use with special configuration outlet boxes where the elongated strap may be longer than desired (e.g., old work or mobile home boxes), strap elements 15 and 16 include break-off sections 27 and 28, which can be snapped off along notches 29 and 30, respectively, and bridging tabs 31 and 32, respectively, to reduce the length of the strap.

For use with wall plates sold under the "SEMI JUMBO" designation by Slater Electric Inc., Glen Cove, N.Y., the overall strap length can be extended to about 4 9/16 to 4⅝ inches. In addition, further elongation can be provided by further mounting strap elements 15*c* and 16*c* (indicated in phantom in FIG. 2) projecting from the end edges of mounting strap elements 15 and 16. respectively. Further strap elements 15*c* and 16*c* are preferably beveled at their end edges (as indicated at 15*d* and 16*d*, respectively), and can be defined by notches 15*e* and 16*e*, respectively, which permit the further strap elements to be snapped off if desired. Also advantageously, strap elements 15 and 16 extend at least as wide as (and preferably wider than) the width of the cover portion and they preferably include squared-off side portions instead of the typical round "ears" found on conventional steel mounting straps.

As disclosed in the aforesaid co-pending application, by maximizing the length of the strap elements, the maximum surface area is provided for ensuring that the strap will abut some surface of a wall member when mounted to an outlet box. This arrangement will greatly reduce the possibility of a "floating" installation.

Referring now to FIGS. 1–6, there is shown the component parts of a preferred embodiment of the improved grounding system according to the present invention. As here embodied, grounding element (40) is provided in the form of a unitary member which may be stamped from a relatively thin, continuous metal strip made of copper alloy. As here embodied, element 40 includes mounting head portion 50, and base portion 60, formed as a unitary part. Head portion 50 is provided with a generally H-shaped aperture (indicated generally at 58) to form a pair of cantilevered spring-like fingers (55, 56) which are adapted to grasp a device mounting screw to initiate the automatic grounding according to the invention, as will be described in greater detail hereinafter.

The resultant H-shaped aperture is thus surrounded by top edge 51, side edges 52 and 53 and connecting segments 54*a*, 54*b*, and 54*c* which connect head portion 50 with base portion 60. Spring-like fingers 55 and 56 extend towards each other from top edge 51 and connecting segment 54*c*, respectively. As is evident from FIG. 5, connecting segments 54*a*, *b* and *c* each have a double bend, or a somewhat S-shape, for locating contact head 50 in proper position adjacent the mounting screw hole 16*a*. In addition, the H-shaped aperture 58 preferably extends through at least the uppermost bend of connecting segments 54*a*, *b* and *c* and down to the second bend to provide increased flexibility and spring action for fingers 55 and 56. Connecting segments 54*a* and *b* thus connect side edges 52 and 53, respectively, to base portion 60, with segment 54*c* connecting finger 56 to base portion 60. As preferably embodied, the width of connecting segment 54*c* equals the total of the widths of connecting segments 54*a* and 54*b*. It will thus be understood that, as a result, each finger 55 and 56 will be equally spring biased so that as a mounting screw is inserted between the fingers, the screw will be subjected to equal, but oppositely directed, spring forces by fingers 55 and 56.

Also advantageously, the ends of both fingers 55 and 56 are bent forward by about 90° to form a pair of flared prongs (55*a* and 56*b*, respectively) which project outwardly from head portion 50. The prongs are positioned to project through aperture 16*a* when the grounding element is located in place, and, advantageously, the distance between the two prongs should be at least slightly less than the diameter of the device mounting screw so that it will be firmly grasped by the prongs and provide good electrical contact therebetween. Also, as preferably embodied, the prongs 55*a* and 56*b* may themselves be bent back towards the rim of aperture 16*a* to help secure, or pre-load, the grounding element onto the cover member 14, as indicated in phantom in FIG. 5.

Base portion 60 is of a generally rectangular shape as defined by edges 60*a*, *b*, *c* and *d*, and is connected to head portion 50 at the interconnection of edge 60*d* with connecting portions 54*a*, *b* and *c*. Advantageously, base portion 60 is provided with receiving aperture 61 and mounting aperture 62 (receiving aperture 61 being generally larger in diameter than mounting aperture 62) which are alignable with threaded mounting hole 20 and aperture 21 in cover 14, respectively, when base 60 is positioned in recessed portion 22 during the final assembly step. Apertures 21 and 62 are proportioned so as to receive a rivet connection (24) therethrough to fixedly attach grounding element 40 to cover 14. Aperture 61 is proportioned to receive the wall plate mounting screw (23), which is then threaded into mounting hole 20 to attach a wall plate to the switch device, and is generally larger in diameter than the shaft of the mounting screw.

To complete the automatic grounding system according to the present invention, switch unit 10 is also provided with an L-shaped ground terminal 41 which is fixedly positioned between grounding element 40 and cover member 14 during the final assembly step, in good electrical contact. with the grounding element. As preferably embodied, terminal 41 includes a head portion 41*a* and a leg portion 41*b* which is bent at approximately 90° in relation to head portion 41*a*. Head portion 41*a* is generally of a rectangular shape and generally wider at one end than leg 41*b* so as to accommodate contact aperture 44*a* and attaching aperture 44*b*, which are aligned with mounting hole 20 and aperture 21 in cover 14, respectively, as described below. Contact aperture 44*a* is proportioned to receive the wall plate mounting screw inserted through aperture 61 of grounding element 40 and has a generally beveled or tapped configuration so that the portions of terminal 41 defining aperture 44*a* will threadably engage the screw and maintain good electrical contact therewith. Attaching aperture 44*b* is proportioned to receive the rivet connection which attaches grounding element 40 to the cover member so that the terminal element can be fixedly attached therebetween. [pilot hole 44*c* is provided in terminal member 41 as a result of the die process used to fabricate the terminal member].

To properly align and retain terminal 41 on the cover 14, the cover member is provided with a generally rectangular recessed portion 22 located adjacent to mounting strap 16 and having mounting hole 20 and aperture 21 constructed therewithin. Advantageously, part of recessed portion 22 is eliminated at the end of cover 14 so that leg 41*b* will not extend beyond the width of the cover when terminal 41 is positioned thereon. Upon assembly, head portion 41*a* will sit in recessed portion 22 so as to align apertures 44*a* and 44*b* with wall plate mounting hole 20 and aperture 21, respectively.

In use, the fully assembled wall switch unit 10 (assembly of the device in accordance with the invention will be described below) is mounted to an electrical outlet box generally in the usual way by inserting the device mounting screws (one is indicated at 7 in FIG. 1) through apertures 15*a* and 16*b* formed in mounting strap elements 15 and 16, respectively. The screw inserted through aperture 16*a* is securely grasped between the pair of flared prongs 55*a* and 56*a* of grounding element 40, forcing the prongs to flex outwardly towards the upper and lower edges of aperture 16*a* (which can act as a limit for the outward flexure of the prongs). As a result, good electrical contact is maintained between the mounting screw and the prongs 55*a* and 56*a*, and, therefore, with the entire grounding element 40. In accordance with a principal advantage of the invention, when the switch is mounted to a metallic electrical outlet box that is already grounded, and a wall plate (metallic) is affixed to the switch, the wall plate will automatically be grounded by virtue of the continuous electrically conductive ground path established from the outlet box, through the device mounting screw, through grounding element 40, thence through terminal member 41 to the wall plate mounting screw.

For installations wherein the outlet box is not grounded (e.g., where plastic boxes are used), terminal member 41 is provided with a ground termination screw (43), threadably engaged through aperture 42 in leg portion 41*b*, for direct termination to the ground conductor of an electrical power cable when needed. Thus, in the event the outlet box has not been grounded so as to take advantage of the automatic grounding provided by the present invention, the wall plate can still be grounded by terminating the ground (green) conductor of an electrical power cable to the ground terminal screw 43. It will be understood that by virtue of the good electrical contact provided between grounding element 40 and terminal 41, an alternate continuous ground path is provided via terminal screw 43, through ground terminal 41 and grounding element 40 to the wall plate mounting screw. Thus, when the ground conductor is terminated to screw 43, the wall plate is grounded through the same grounding system that provides the automatic grounding capability.

Assembly of the switch device according to the invention is relatively simple to carry out. The switch unit body is placed on its bottom wall and the electrical terminal/contact members 25 and 26, toggle 18, and the other components in the switching mechanism are simply seated in their appropriate receiving and retaining structures. Head portion 41*a* of terminal member 41 is placed in recessed portion 22 of cover member 14 such that apertures 44*a* and 44*b* align with mounting hole 20 and aperture 21, respectively. The grounding element 40 is positioned in recessed portion 22 on top of terminal member 41 such that mounting apertures 61 and 62 align with apertures 44*a* and 44*b* in terminal member 41, respectively, and thus with mounting hole 20 and aperture 21, respectively. Additionally, prongs 55*a* and 56*a* of grounding element 40 are bent over the rim of aperture 16*a* to pre-load element 40 onto the cover. Grounding element 40 and terminal 41 are then secured in fixed electrical contact to cover 14 by passing a rivet through aligned aperture 62, 44*b* and 21.

The cover, with grounding element 40 and terminal member 41 attached thereto, is placed over body member 12 (with the handle and on-off face portion of toggle 18 received through aperture 17) and the cover and body are forced against each other for final assembly. As preferably embodied, the cover and body are fastened together by sonic welding whereby the cover and body become joined together and form a welded seam along their abutting side and end wall edges. It will be understood that by using sonic welding techniques, the strength of the bond between the body and cover is at least as strong as the actual wall segments which are welded together, thereby obviating any of the potential dangers of loosening of electrical connections within the device which otherwise can result from a weakened rivet or screw-type fastener.

It will be appreciated by those skilled in the art that the grounding system of the present invention may be adapted such that automatic grounding of a metallic wall plate can be carried out by use of either grounding element 40 or terminal member 41 in and of themselves. For example, grounding element 40 can be adapted so that the edges of element 40 defining aperture 61 will engage, and establish good electrical contact with, the wall plate mounting screw when inserted thereinto. Aperture 44*a* in terminal 41 is proportioned to a diameter generally larger than aperture 61 to allow the shaft of the mounting screw to pass therethrough and engage mounting hole 20. Accordingly, a continuous electrical ground path will be established from the electrical outlet box to the wall plate mounting screw through grounding element 40, with terminal element 41 providing an alternate ground path for installations wherein the outlet box is not pre-grounded. So too, if the outlet box is not pre-grounded, terminal element 41 as disclosed herein can be used by itself, thus establishing a continuous ground path from the wall plate mounting screw, through terminal 41, to the ground conductor of an electrical power cable attached to terminal screw 43.

Referring now to FIGS. 7–12, there is shown a preferred embodiment of the automatic grounding system of the present invention for use with decorator-style switches which illustrates how the invention can be adapted to permit the grounding element to be attached to the back of the cover. As can be seen from the accompanying drawings, the typical decorator switch is provided with a tap plate or "paddle" (indicated generally at 66) which forms part of the cover member (indicated generally at 64) for activating/deactivating the switch. The paddle is usually proportioned so as to occupy most of the front facing surface area of the cover, thus providing little room for attaching the wall plate grounding element. The external configuration and internal workings of the decorator switch device of the present invention are essentially the same as that disclosed in Hoehn et al., U.S. Pat. No. 3,684,847, the disclosure of which is incorporated herein by reference. Only those differences material to the present invention will be described in detail herein.

As with the toggle switch device, the cover is formed with integral elongated mounting strap elements (indicated at 100, 105) which may be fabricated with the special features hereinbefore described. Each mounting strap is provided with a mounting screw receiving aperture (101, 106) through which the device is mounted to the outlet box, and a wall plate screw receiving aperture (102, 107) through which the wall plate is affixed to the switch.

Figure 7:
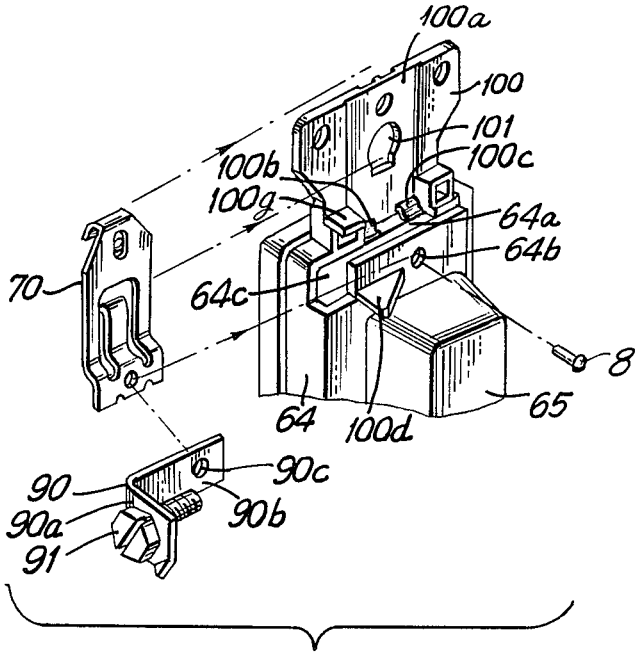
FIG. 7 is an inverted partial perspective view, from the rear side, of a decorator style switch showing adaptation of the automatic grounding mean of the present invention thereto.
Figure 10:
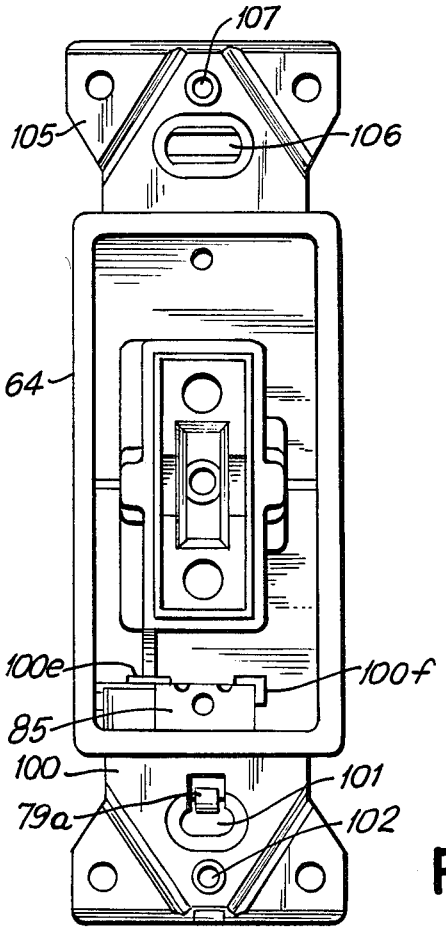
FIG. 10 is an open front facing internal view of a decorator switch cover member showing positioning of the grounding element of FIG. 11 therein.
Figure 8:
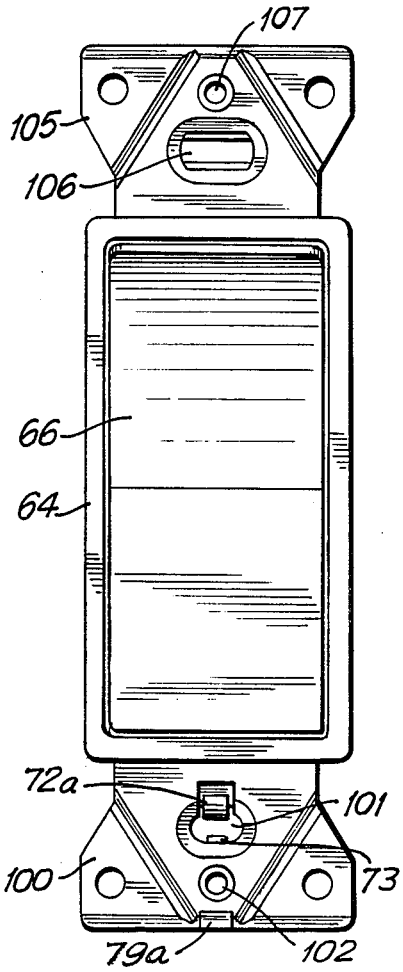
FIG. 8 is a front elevation view of the decorator style switch device of FIG. 7.
Figure 9:
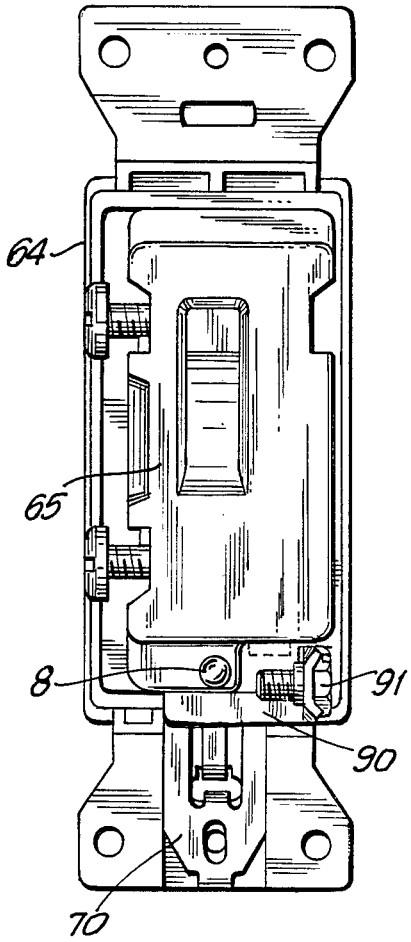
FIG. 9 is a rear elevation view of the decorator style switch device of FIG. 7.

As shown in FIG. 7, the back of cover 64 is constructed with a slotted opening 64*a* adjacent mounting strap element 100, proportioned to slidably receive grounding element 70 and ground terminal 90. A portion of cover 64 is removed at one edge of slot 64*a* (as indicated by notch 64*c*) so to accommodate leg portion 90*b* of terminal 90, and thus prevent leg portion 90*b* from extending beyond the width of the cover. The cover is also provided with a receiving aperture 64*b* through which grounding element 70 and terminal 90 are fixedly attached to the cover with a suitable fastener, as described in more detail below.

Figure 11:
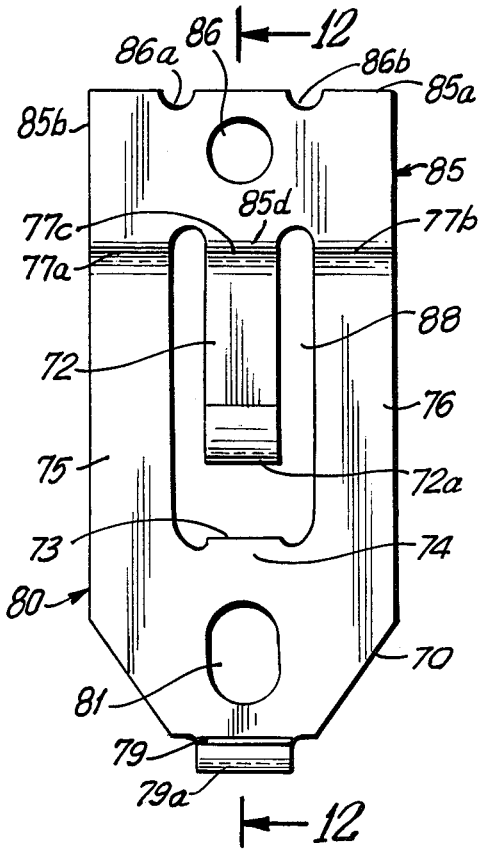
FIG. 11 is a plan view of an embodiment of the grounding element according to the present invention for use with decorator style switches.
Figure 12:
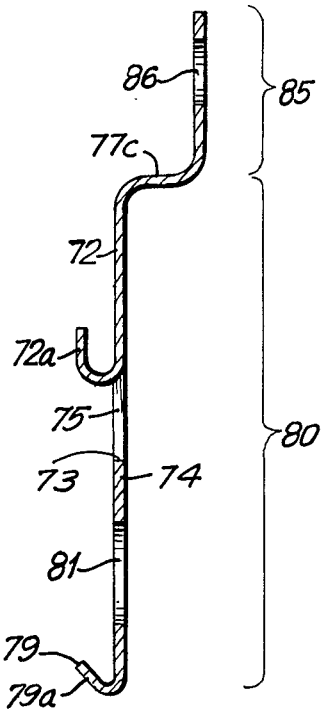
FIG. 12 is a sectional view taken along line 12-12 of the grounding element shown in FIG. 10.

Referring specifically to FIGS. 7 and 11–12, the component parts of the grounding system for the decorator style embodiment of the present invention are shown. As with grounding element 40 hereinbefore described, grounding element 70 is provided in the form of a unitary member which may be stamped from a relatively thin, continuous metal strip made of copper alloy to provide automatic grounding in a single unitary part.

Element 70 includes mounting head portion 80 and base portion 85 formed as a unitary part. Head portion 80 is provided with a generally U-shaped aperture (indicated generally at 88) to form a first clip member 72 which is proportioned to electrically contact a device mounting screw to provide the automatic grounding according to the invention. [Lip portion 73 is formed at the bottom of U-shaped aperture 88 as a result of the stamping process used to fabricate grounding element 70].

The resultant U-shaped aperture is thus surrounded by top edge 74, side edges 75 and 76, and connecting segments 77*a*, 77*b*, and 77*c* which connect head portion 80 with base portion 85. As is evident from FIG. 12, connecting segments 77*a*, b and *c* each have a double bend, or somewhat S-shape, for locating element 70 in proper position adjacent mounting screw aperture 101. Connecting segments 77*a* and *b* thus connect side edges 75 and 76, respectively, to stem portion 85, with segment 77*c* connecting clip member 72 to stem portion 85.

Also advantageously, clip member 72 is provided with a curled end portion 72*a* which is proportioned to project into mounting screw aperture 101 and curl over the upper edge thereof when element 70 is attached to the cover member as described below. Thus, end portion 72*a* will extend upwardly into aperture 101 so as to electrically contact a device mounting screw inserted therethrough, and grasp the upper edge of aperture 101 in response to the inward force exerted by the mounting screw when inserted through aperture 101 so as to prevent clip member 72 from bending backward out of electrical contact with the mounting screw.

As preferably embodied, head portion 80 is also provided with an oblong contact aperture 81 to receive a wall plate mounting screw inserted into receiving aperture 102. Contact aperture 81 is proportioned so that the portions of grounding element 70 defining the aperature will engage and maintain good electrical contact with the wall plate mounting screw. Further, head portion 80 is formed with a second clip member 79 also having a curled end portion 79*a* proportioned to engage the top edge of mounting strap element 100 upon attachment of element 70 to cover 64 so as secure element 70 to the back of the mounting strap.

Base portion 85 is of a generally rectangular shape as defined by edges 85*a*, *b*, *c* and *d*, and is connected to head portion 80 at the interconnection of edge 85*d* with connecting portions 77*a*, *b* and *c*. Advantageously, base portion 85 is provided with a mounting aperture 86 to be aligned with aperture 64*b* in cover 64 when base 85 is positioned in slot 64*a* during the final assembly step. Apertures 64*b* and 86 are proportioned so as to receive a suitable fastener therethrough (here a rivet connection indicated at 8) to secure grounding element 70 to cover 64. [Notches 86*a* and 86*b* located on the end edge of base 85 are formed as a result of the stamping process used to fabricate grounding element 70.].

As preferably embodied, L-shaped ground terminal 90 is also provided as an alternative means for grounding the wall plate for installations wherein the outlet box is not grounded. As here embodied, L-shaped terminal 90 includes head portion 90*a* and leg portion 90*b* which contains a ground termination screw 91 for direct termination to a ground conductor when needed. Leg portion 90*b* carries a mounting hole 90*c* for alignment with aperture 86 in grounding element 70 and aperture 64*b* in cover 64 when the leg portion of terminal 90 is inserted into slotted opening 64*a*. Mounting hole 90*c* is proportioned to receive fastener 8 which attaches grounding element 70 to cover 64, with terminal 90 therebetween, for good electrical contact.

Advantageously, cover 64 and mounting strap element 100 are specially adapted to ensure proper positioning and alignment thereon of the decorator switch grounding system of the present invention. As preferably embodied, the back of mounting strap element 100 is provided with a slightly indented surface 100*a* proportioned to receive and align head portion 80 of grounding element 70. Additionally, the mounting strap is formed with curved guide portions 100*b* and 100*c* for supporting S-shaped segments 77*a* and 77*b* when the device is fully assembled, leaving segment 77*c* generally unsupported. Cover 64 is formed with upstanding studs 100*e* and 100*f* (L-shaped) to support base portion 85 in proper alignment, and thus ensure proper alignment of aperture 86 with aperture 64*b* in cover 64. Finally, outwardly projecting rib portions 100*c* and 100*d* are formed on mounting strap element 100 and cover 64, respectively, to help align terminal element 90 in slot 64*a*, with rib 100*c* additionally acting as a stop against upward vertical movement of terminal 90.

To assemble the decorator switch embodiment of the present invention, the contact/terminal members and internal switching components are positioned in the body member in the conventional way. Grounding element 70 is slidably inserted in slot 64*a* with curved end portion 79*a* of clip member 79 clipped over the top edge of mounting strap 100 to secure element 70 to the strap. End portion 72*a* of clip member 72 is curled over the upper edge of mounting screw aperture 101. Aperture 86 in base portion 85 is aligned with aperture 64*b* in the cover member and leg portion 90*b* of terminal element 90 is slidably inserted in slot 64*a* and placed over stem portion 85 such that aperture 90*c* is aligned with aperture 86 and 64*b*. A suitable fastener (e.g., rivet 8) is inserted through aligned apertures 64*b*, 90*c*, and 86, and compressed to secure base portion 85 to the cover and engage leg portion 90*b* therebetween in good electrical contact with element 70. Paddle 66 is placed in cover 64, and the cover is then placed over body 65. The cover and body are then forced together and preferably subjected to sonic welding along the engagement thereof.

The fully assembled switch is then mounted to an electrical outlet box by mounting screws inserted through apertures 101 and 106 in the mounting strap elements. The screw inserted through aperture 101 will electrically engage curled end portion 72*a* of grounding element 70. A wall plate is affixed to the switch by inserting w 11 plate mounting screws through apertures 102 and 107 formed in the mounting straps. The mounting screw inserted through aperture 102 will pass through contact aperture 81 of grounding element 70 and thereby electrically contact the grounding element.

As a result, for installations where the outlet box is pre-grounded, a continuous electrically conductive ground path is established from the outlet box, through the device mounting screw, through grounding element 70 to the wall plate mounting screw. For installations where the outlet box is not pre-ground, an alternative ground path is established from the ground conductor to terminal screw 91, through terminal member 90, through grounding element 70 to the wall plate mounting screw.

ALTERNATIVE EMBODIMENT OF GROUNDING ELEMENT ATTACHING MEANS

Because many commercial switch devices employ rivet or screw-like fastening techniques to connect the body and cover members, FIGS. 13–14 portray an alternative embodiment of the attachment means for the improved grounding system of the present invention to accommodate such devices.

Figure 13A:
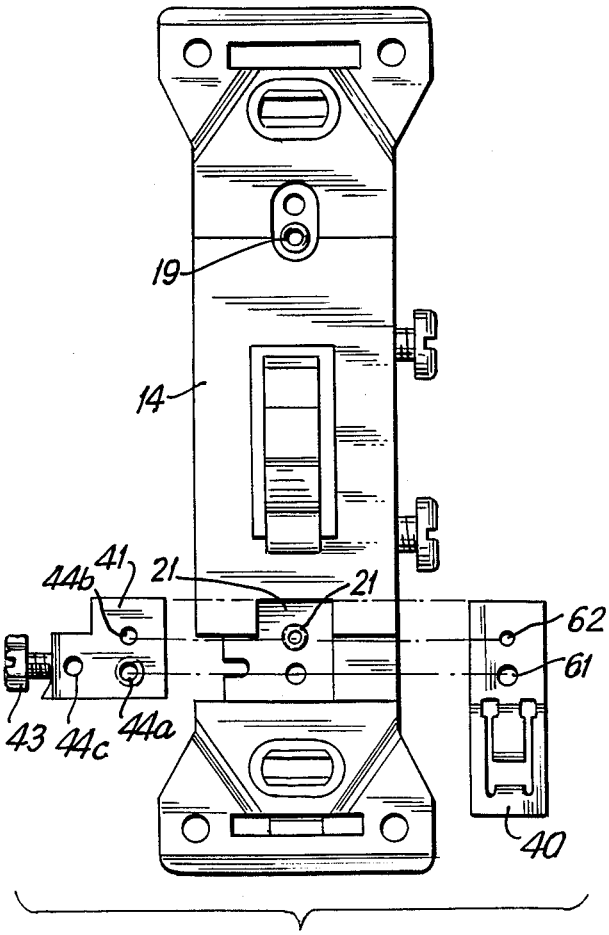
FIGURES 13A and B are full frontal and rear views of the switch device of FIG. 1 showing an alternative embodiment of the attachment means for the grounding element of FIG. 4.
Figure 13B:
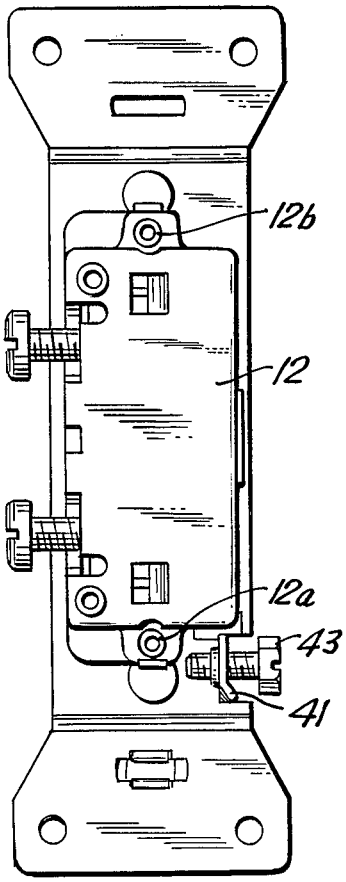

In the typical toggle switch device shown in FIGS. 13A and 13B, the body member is provided with opposed coupling apertures 12*a* and 12*b*. Upon mating the cover and body members, coupling apertures 12*a* and 12*b* are aligned, respectively, with aperture 21 in cover member 14 and aperture 19 formed in the cover for receiving a rivet or other fastener therethrough. Thus, when grounding element 40 and ground terminal 41 are positioned in electrical contact in recessed portion 22, aperture 62 of element 40 and oval portion 42*b* of terminal 41 will align with each other, as well as with aligned apertures 21 and 12*a* such that the rivet or fastener will also fixedly attach grounding element 40 to the cover and engage terminal element 41 therebetween in electrical contact with element 40.

Figure 14B:
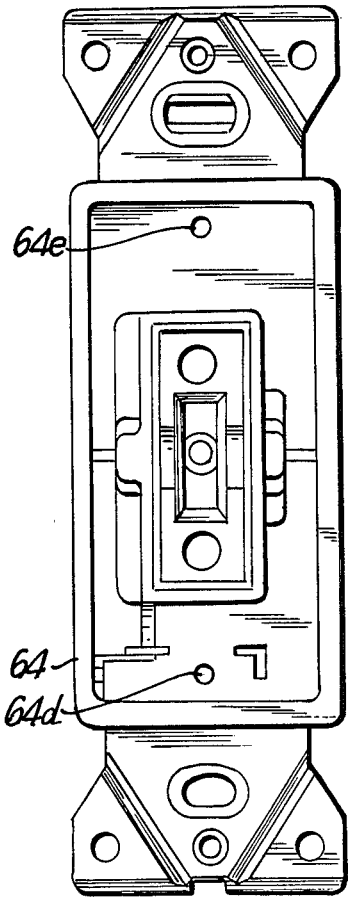
FIGURES 14A and B are full frontal and rear views of the switch device of FIG. 10 showing an alternative embodiment of the attachment means for the grounding element of FIG. 7.
Figure 14A:
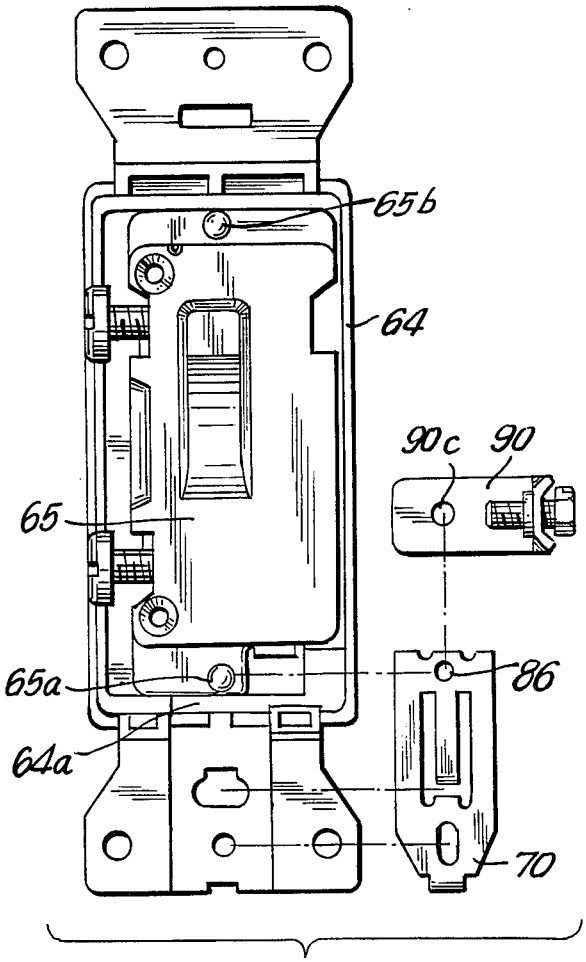

As shown in FIGURES 14A and 14B, the same principle can be applied to decorator-style switches. Thus, body 65 is provided with coupling apertures 65*a* and 65*b* which are aligned, respectively, with aperture 64*d* and aperture 64*e* formed in the rear facing surface of cover 64 to receive the rivet or fastener. When grounding element 70 and terminal element 90 are slidably inserted into slot 64*a* as hereinbefore described, aperture 90*c* in terminal element 90 and aperture 86 in element 70 will be aligned with each other, as well as with aligned aperture 65*a* and 64*b* such that the same fastener connecting the mated cover and body members will also attach grounding element 70 to the cover and fixedly engage terminal 90 therebetween in electrical contact with element 70.

It will be readily appreciated that the invention in its broader aspects is not limited to the specific embodiments herein shown and described. Rather, variations may be made therefrom within the scope of the accompanying claims without departing from the principles of the invention and without sacrificing its chief advantages.

What is claimed is:

1. An electrical switch device adapted to be secured to an electrical outlet box mounted behind a wall member, and having a pair of opposed mounting holes adapted to threadably receive the mounting screws of a wall plate intended for use with the device, comprising:

a receptacle body member adapted to receive and retain electrical terminal assemblies which are adapted to be terminated to the conductors of an electrical power cable;

a cover member adapted to be mated with said body member and fixedly connected thereto to form a housing substantially enclosing said electrical terminal assemblies;

a pair of non-metallic mounting strap elements formed integrally with said cover member and projecting from opposite ends thereof, each of said pair of mounting strap elements having a mounting screw aperture therethrough and elongated to the maximum possible length to fit under the wall plate, such that when said switch assembly is secured to the outlet box, the probability that the mounting strap elements will abut the wall member is maximized so as to substantially reduce the chance of having a "floating" installation;

grounding means secured to said cover member adjacent one of said mounting screw apertures, said grounding means adapted to engage a device mounting screw inserted through said one mounting screw aperture so as to provide good electrical communication therebetween, said grounding means further adapted to electrically engage a wall plate mounting screw inserted into one of said wall plate mounting holes, such that when said switch device is secured to a pre-grounded electrical outlet box with the wall plate affixed thereto, a continuous electrically conductive ground path is provided from the outlet box through the device mounting screw, through said grounding means, thence through the wall plate mounting screw for automatically grounding the wall plate;

attaching means adapted to fixedly attach said grounding means to said cover member; and connecting means adapted to fixedly connect said mated cover and body members.

2. An electrical switch device according to claim 1, wherein said grounding means comprises:

a unitary grounding element in the form of a strip of copper alloy, said grounding element having a pair of spring-like finger members at one end, said finger members positioned and proportioned to extend through said one mounting screw aperture for engaging said device mounting screw, said grounding element formed with a receiving aperture aligned with said one wall plate mounting hole and proportioned to receive said wall plate mounting screw inserted into said one wall plate mounting hole; and an additional ground member positioned on said cover member in electrical contact with said grounding element, said additional ground member formed with a contact aperture aligned with said receiving aperture formed on said grounding element and said one wall plate mounting hole, said contact aperture proportioned so that the portions of said additional ground member defining said contact aperture electrically engage said wall plate mounting screw inserted into said one wall plate mounting hole, said additional ground member further including a ground terminal screw for permitting direct termination of a ground conductor in an electrical power cable to said switch device to provide an alternate means for grounding the wall plate when automatic grounding of the wall plate is not carried out through the device mounting screw.

3. An electrical switch device according to claim 2, wherein said grounding element includes a head portion having a generally H-shaped opening formed therein to provide said pair of spring-like fingers which project toward each other to protrude into said one mounting screw aperture, said finger members being bent outwardly so as to protrude substantially through said one mounting screw aperture.

4. An electrical switch device according to claim 3, wherein said spring-like finger members are spring biased so as to move away from each other with a generally equal but oppositely directed spring biasing force.

5. An electrical switch device according to claim 4, wherein each of said pair of spring-like finger members is provided with a prong portion at the free end thereof, said prong portions bendable away from each other around the rim of said one mounting screw aperture to help attach said grounding element to said cover member.

6. An electrical switch device according to claim 5, wherein said attaching means is provided by cooperating attaching apertures formed on said cover member, grounding element, and additional ground member, said cooperating attaching apertures proportioned to receive a suitable fastener to secure said grounding element and additional ground member to said cover member.

7. An electrical switch device according to claim 1, wherein said grounding means comprises a unitary grounding element in the form of a strip of copper alloy including a head portion having a generally H-shaped opening formed therein providing a pair of spring-like finger members which project toward each other and bend outward so as to protrude substantially through said one mounting screw aperture to engage a device mounting screw inserted through said one mounting screw aperture so as to provide good electrical communication therebetween, said spring-like finger members spring biased so as to move away from each other with a generally equal but oppositely directed spring biasing force, said grounding element formed with a contact aperture aligned with said one wall plate mounting hole, said contact aperture proportioned so that the portions of said grounding element defining said contact aperture electrically engage said wall plate mounting screw inserted into said one wall plate mounting hole.

8. An electrical switch device according to claim 7, wherein each of said pair of spring-like finger members is provided with a prong portion at the free end thereof, said prong portions bendable away from each other around the rim of said one mounting screw aperture to help attach said grounding element to said cover member.

9. An electrical switch device according to claim 8, wherein said attaching means is provided by cooperating attaching apertures formed on said cover member and grounding element, said cooperating attaching apertures proportioned to receive a suitable fastener to secure said grounding element to said cover member.

10. An electrical switch device according to claim 9, which further includes an additional ground member positioned on said cover member in electrical contact with said grounding element, said additional ground member including a ground terminal screw for permitting direct termination of a ground conductor in an electrical power cable to said switch device to provide an alternate means for grounding the wall plate when automatic grounding of the wall plate is not carried out through the device mounting screw, said additional ground member providing a receiving aperture aligned with said contact aperture and said one wall plate mounting hole and proportioned to receive said wall plate mounting screw inserted into said one wall plate mounting hole, said additional ground member further providing an attaching aperture alignable with said cooperating attaching apertures formed on said cover member and said grounding element, said attaching aperture proportioned to receive said fastener inserted through said cooperating attaching apertures to secure said additional ground member to said cover member in good electrical contact with said grounding element.

11. An electrical switch device according to claim 1, wherein said grounding means comprises a unitary grounding element in the form of a strip of copper alloy, said grounding element formed with a head portion providing a first clip member and a second clip member, said first clip member adapted to engage the top edge of the mounting strap element providing said one mounting screw aperture so as to secure said grounding element thereto, said second clip member proportioned to project into said one mounting screw aperture so as to electrically contact said mounting screw when inserted thereinto, said grounding element further formed with a contact aperture aligned with said one wall plate mounting hole, said contact aperture proportioned so that the portions of said grounding element defining said contact aperture electrically engage said wall plate mounting screw inserted into said one wall plate mounting hole.

12. An electrical switch device according to claim 11, wherein the head portion of said grounding element includes a generally U-shaped opening formed therein to provide said second clip member.

13. An electrical switch device according to claim 12, wherein said attaching means is provided by cooperating attaching apertures formed on said cover member and on said grounding element, said cooperating attaching apertures proportioned to receive a suitable fastener to secure said grounding element to said cover member.

14. An electrical switch device according to claim 13, which further includes an additional ground member positioned on said cover member in electrical contact with said grounding element, said additional ground member including a ground terminal screw for permitting direct termination of a ground conductor in an electrical power cable to said switch device to provide an alternate means for grounding the wall plate when automatic grounding of the wall plate is not carried out through the device mounting screw, said additional ground member further providing an attaching aperture alignable with said cooperating attaching apertures formed on said cover member and said grounding element, said attaching aperture proportioned to receive said fastener inserted through said cooperating attaching apertures to secure said additional ground member to said cover member in good electrical contact with said grounding element.

15. An electrical switch device according to claim 1, wherein said body and cover members, and said mounting strap elements, are formed from an injection moldable thermo-plastic material.

16. An electrical switch device according to claim 1, wherein said connecting means is provided by sonic welding techniques.

17. An electrical switch device according to claim 1, wherein said connecting means comprises cooperating pairs of connecting apertures formed on said cover member and on said body member, said cooperating pairs of connecting apertures proportioned to receive a rivet-like fastener inserted therethrough to secure said cover and body members together.

18. The electrical switch device according to claim 6, wherein said device is of a toggle-type configuration.

19. The electrical switch device according to claim 10, wherein said device is of a toggle-type configuration.

20. The electrical switch device according to claim 14, wherein said device is of a decorator-style configuration.

21. An electrical toggle switch device adapted to be secured to an electrical outlet box mounted behind a wall member and having a pair of opposed mounting holes adapted to threadably receive the mounting screws of a wall plate intended for use with the device, comprising:

a receptacle body member adapted to receive and retain electrical terminal assemblies which are adapted to be terminated to the conductors of an electrical power cable;

a cover member adapted to be mated with said body member and fixedly connected thereto to form a housing substantially enclosing said electrical terminal assemblies;

a pair of non-metallic mounting strap elements formed integrally with said cover member and projecting from opposite ends thereof, each of said pair of mounting strap elements having a mounting screw aperture therethrough and elongated to the maximum possible length to fit under the wall plate, such that when said switch assembly is secured to the outlet box, the probability that the mounting strap elements will abut the wall member is maximized so as to substantially reduce the chance of having a "floating" installation;

a unitary grounding element in the form of a strip of copper alloy secured to said cover member adjacent one of said mounting screw apertures, said grounding element formed with a head portion having a generally H-shaped opening formed therein providing a pair of spring-like finger members which project toward each other and bend outward so as to protrude substantially through said one mounting screw aperture to engage a device mounting screw inserted through said one mounting screw aperture so as to provide good electrical communication therebetween, said grounding element formed with a receiving aperture aligned with one of said wall plate mounting holes and proportioned to receive a wall plate mounting screw inserted into said onewall plate mounting hole;

an additional ground member positioned on said cover member in electrical contact with said grounding element, said additional ground member formed with a contact aperture aligned with said receiving aperture formed on said grounding element and said one wall plate mounting hole, said contact aperture proportioned so that the portions of said additional ground member defining said contact aperture electrically engage said wall plate mounting screw inserted into said one wall plate mounting hole, such that when said switch assembly is mounted to a pre-grounded electrical outlet box, and said wall plate affixed thereto, a continuous electrically conductive ground path is provided from the outlet box through the mounting screw, through said grounding means, thence through the wall plate mounting screw for automatically grounding the wall plate, said additional ground further providing a ground terminal screw for permitting direct termination of a ground conductor in an electrical power cable to said switch device to provide an alternate means for grounding the wall plate when automatic grounding of the wall plate is not carried out through the device mounting screw;

attaching means adapted to fixedly attach said grounding means to said cover member; and connecting means adapted to fixedly connect said mated cover and body members.

22. An electrical switch device according to claim 21, wherein said spring-like finger members are spring biased so as to move away from each other with a generally equal but oppositely directed spring biasing force.

23. An electrical switch device according to claim 22, wherein each of said pair of spring-like fingers is provided with a prong portion at the free end thereof, said prong portions bendable away from each other around the rim of said one mounting screw aperture to help attach said grounding element to said cover member.

24. An electrical switch device according to claim 23, wherein said attaching means is provided by cooperating attaching apertures formed on said cover member, grounding element, and additional ground member, said cooperating attaching apertures proportioned to receive a suitable fastener to secure said grounding element and additional ground member to said cover member.

25. An electrical switch device according to claim 21, wherein said body and cover members, and said mounting strap elements, are formed from an injection moldable thermo-plastic material.

26. An electrical switch device according to claim 21, wherein said connecting means is provided by sonic welding techniques.

27. An electrical decorator-style switch device adapted to be secured to an electrical outlet box mounted behind a wall member, and having a pair of opposed mounting holes adapted to threadably receive the mounting screws of a wall plate intended for use with the device, comprising:

a receptacle body member adapted to receive and retain electrical terminal assemblies which are adapted to be terminated to the conductors of an electrical power cable;

a cover member adapted to be mated with said body member and fixedly connected thereto to form a housing substantially enclosing said electrical terminal assemblies;

a pair of non-metallic mounting strap elements formed integrally with said cover member and projecting from opposite ends thereof, each of said pair of mounting strap elements having a mounting screw aperture therethrough and elongated to the maximum possible length to fit under the wall plate, such that when said switch device is secured to the outlet box, the probability that the mounting strap elements will abut the wall member is maximized so as to substantially reduce the chance of having a "floating" installation;

a unitary grounding element in the form of a strip of copper alloy secured to said cover member adjacent one of said mounting screw apertures, said grounding element formed with a head portion providing a first clip member adapted to engage the top edge of said one mounting strap element so as to secure said grounding element thereto, said head portion having a generally U-shaped opening formed therein to provide a second clip member, said second clip member proportioned to project into said one mounting screw aperture so as to electrically contact said mounting screw when inserted thereinto, said grounding element further formed with a contact aperture aligned with one of said pair of wall plate mounting holes, said contact aperture proportioned so that the portions of said grounding element defining said contact aperture electrically engage said wall plate mounting screw inserted into said one wall plate mounting hole, such that when said switch device is mounted to a pre-grounded electrical outlet box, and said wall plate affixed thereto, a continuous electrically conductive ground path is provided from the outlet box through the mounting screw, through said grounding means, thence through the wall plate mounting screw for automatically grounding the wall plate;

attaching means adapted to fixedly attach said grounding element to said cover member; and connecting means adapted to fixedly connect said mated cover and body members.

28. An electrical switch device according to claim 27, wherein said attaching means is provided by cooperating attaching apertures formed on said cover member and on said grounding element, said cooperating attaching apertures proportioned to receive a suitable fastener to secure said grounding element to said cover member.

29. An electrical switch device according to claim 28, which further comprises an additional ground member positioned on said cover member in electrical contact with said grounding element, said additional ground member including a ground terminal screw for permitting direct termination of a ground conductor in an electrical power cable to said switch assembly to provide an alternate means for grounding the wall plate when automatic grounding of the wall plate is not carried out through the device mounting screw, said additional ground member further providing an attaching aperture alignable with said cooperating attaching apertures formed on said cover member and said grounding element, said attaching aperture proportioned to receive said fastener inserted through said cooperating attaching apertures so as to secure said additional ground member to said cover member in good electrical contact with said grounding element.

30. An electrical switch device according to claim 27, wherein said body and cover members, and said mounting strap elements, are formed from an injection moldable thermo-plastic material.

31. An electrical switch device according to claim 27, wherein said connecting means is provided by sonic welding techniques.

32. An electrical toggle switch device adapted to be secured to an electrical outlet box mounted behind a wall member and having a pair of opposed mounting holes adapted to threadably receive the mounting screws of a wall plate intended for use with the device, comprising:

a receptacle body member adapted to receive and retain electrical terminal assemblies which are adapted to be terminated to the conductors of an electrical power cable;

a cover member adapted to be mated with said body member and fixedly connected thereto to form a housing substantially enclosing said electrical terminal assemblies;

a pair of non-metallic mounting strap elements formed integrally with said cover member and projecting from opposite ends thereof, each of said pair of mounting strap elements having a mounting screw aperture therethrough and elongated to the maximum possible length to fit under the wall plate, such that when said switch assembly is secured to the outlet box, the probability that the mounting strap elements will abut the wall member is maximized so as to substantially reduce the chance of having a "floating" installation;

a ground terminal member secured to said cover member adjacent one of said mounting screw apertures, said ground terminal member formed with a contact aperture aligned with one of said wall plate mounting holes, said contact aperture proportioned so that the portions of said ground terminal member defining said contact aperture electrically engage said wall plate mounting screw inserted into said one wall plate mounting hole, said ground terminal member further providing a ground terminal screw for permitting direct termination of a ground conductor in an electrical power cable, such that when said switch assembly is mounted to an electrical outlet box which is not pre-grounded, and said wall plate affixed thereto, a continuous electrically conductive ground path is provided from said ground terminal screw, through said terminal member, thence through the wall plate mounting screw for automatically grounding the wall plate.

attaching means adapted to fixedly attach said grounding means to said cover member; and connecting means adapted to fixedly connect said mated cover and body members.

33. An electrical switch device according to claim 32, wherein said attaching means is provided by cooperating attaching apertures formed on said cover member and ground terminal member, said cooperating attaching apertures proportioned to receive a suitable fastener to secure said ground terminal member to said cover member.

34. An electrical switch device according to claim 32, wherein said body and cover members, and said mounting strap elements, are formed from an injection moldable thermo-plastic material.

35. An electrical switch device according to claim 32, wherein said connecting means is provided by sonic welding techniques.

36. A method for assembling an electrical toggle switch device having a cover member, a pair of opposed mounting strap elements, and a body member, all formed from an injection moldable thermo-plastic material, each of said pair of opposed mounting strap elements formed integrally with said cover member and providing a mounting screw receiving aperture, said method comprising the steps of:

inserting electrical terminal assemblies into the interior of said cover member when lying on its bottom wall;

pre-loading a grounding element formed with a pair of spring-like screw engaging finger members onto the cover member adjacent one of said mounting screw apertures in electrical contact with an additional ground member formed with a wall plate contact aperture and a ground termination screw for direct termination to a ground conductor in an electrical cable by aligning cooperating attaching apertures formed on the cover, grounding element, and additional ground member, and inserting a suitable fastener therethrough, such that said finger members protrude through said one mounting screw aperture, and such that said contact aperture is aligned with a wall plate mounting hole formed on said cover to receive a wall plate mounting screw;

placing the cover member over the open top of the switch body;

forcing said cover member and body member against each other to secure the terminal members in place; and sonically welding the cover and body members together to form a securely assembled switch housing.

37. A method according to claim 36, wherein said pre-loading step further includes the step of bending said spring-like finger members about the rim of said one mounting screw aperture to help fasten said grounding element to said cover member.

38. A method for assembling a decorator-style electrical switch device having a cover member, a pair of opposed mounting strap elements, and a body member, all formed from an injection moldable thermo-plastic material, each of said pair of opposed mounting strap elements formed integrally with said cover member and providing a mounting screw receiving aperture, said method comprising the steps of:

inserting electrical terminal assemblies into the interior of said cover member when lying on its bottom wall;

pre-loading a grounding element formed with a wall plate mounting screw contact aperture and a pair of clip members onto the cover member adjacent one of said mounting screw apertures by aligning cooperating attaching apertures formed in the cover and grounding element and inserting a suitable fastener therethrough, such that one of said pair of clip members engages the top edge of the mounting strap element providing said one mounting screw aperture to secure the grounding element thereto, the second of said pair of clip members projects through said one mounting screw aperture, and such that said contact aperture aligns with a wall plate mounting hole formed in said cover member to receive a wall plate mounting screw;

placing the cover member over the open top of the switch body;

forcing said cover member and body member against each other to secure the terminal members in place; and sonically welding the cover and body members together to form a securely assembled switch housing.

39. A method according to claim 38, which further includes the step of attaching an additional grounding member on said cover member in electrical contact with said grounding element by aligning an attaching aperture formed on said additional grounding element with said cooperating attaching apertures formed on said cover and grounding element and inserting said fastener therethrough to provide alternate grounding means via a ground terminal screw on said additional grounding element for direct termination to a ground conductor in an electrical power cable.

* * * * *